US009267401B2

(12) United States Patent
Noguchi et al.

(10) Patent No.: US 9,267,401 B2
(45) Date of Patent: Feb. 23, 2016

(54) VALVE TIMING CONTROLLER

(71) Applicant: AISIN SEIKI KABUSHIKI KAISHA, Kariya-shi (JP)

(72) Inventors: Yuji Noguchi, Obu (JP); Kazunari Adachi, Chiryu (JP); Kenji Ikeda, Nagoya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 0 days.

(21) Appl. No.: 14/403,426

(22) PCT Filed: Jun. 20, 2013

(86) PCT No.: PCT/JP2013/066943

§ 371 (c)(1),
(2) Date: Nov. 24, 2014

(87) PCT Pub. No.: WO2014/038267

PCT Pub. Date: Mar. 13, 2014

(65) Prior Publication Data

US 2015/0096513 A1 Apr. 9, 2015

(30) Foreign Application Priority Data

Sep. 4, 2012 (JP) ..... 2012-194377

(51) Int. Cl.
*F01L 1/34* (2006.01)
*F01L 1/356* (2006.01)
*F01L 1/344* (2006.01)

(52) U.S. Cl.
CPC ..... *F01L 1/356* (2013.01); *F01L 1/3442* (2013.01); *F01L 2001/34423* (2013.01); *F01L 2103/00* (2013.01)

(58) Field of Classification Search
CPC ..... F01L 1/356; F01L 1/3442; F01L 2001/34423
USPC ..... 123/90.15, 90.17
See application file for complete search history.

(56) References Cited

U.S. PATENT DOCUMENTS 5,836,276 A 11/1998 Iwasaki et al.
6,418,895 B1 7/2002 Miyasaka et al.
(Continued)

FOREIGN PATENT DOCUMENTS

DE 101 34 320 A1 1/2003
EP 2 428 656 A1 3/2012
(Continued)

OTHER PUBLICATIONS

International Search Report (PCT/ISA/210) mailed on Jul. 23, 2013, by the Japanese Patent Office as the International Searching Authority for International Application No. PCT/JP2013/066943.
(Continued)

*Primary Examiner* — Ching Chang
(74) *Attorney, Agent, or Firm* — Buchanan Ingersoll & Rooney PC

(57) ABSTRACT

A valve timing controller includes a driving-side rotary member, a driven-side rotary member, an advancing chamber and a retarding chamber formed as a fluid pressure chamber is partitioned by a partitioning portion provided on an outer circumferential side of the driven-side rotary member, and a phase controlling section. The driven-side rotary member includes an advancing passage communicated to the advancing chamber and a retarding passage communicated to the retarding chamber. The driving-side rotary member is formed of an aluminum-based material. The driven-side rotary member integrally includes an outer circumferential member having the partitioning portion and formed of an aluminum-based material, and an inner circumferential member constituting an inner circumferential side of the outer circumferential member and formed of an iron-based material.

7 Claims, 7 Drawing Sheets

(56) References Cited

U.S. PATENT DOCUMENTS

| | | | | |
|---|---|---|---|---|
| 8,171,904 | B2 * | 5/2012 | Watanabe | F01L 1/3442 123/90.15 |
| 2002/0152978 | A1 | 10/2002 | Todo | |
| 2003/0037741 | A1 | 2/2003 | Kohrs | |
| 2010/0218736 | A1 | 9/2010 | Watanabe | |
| 2012/0060779 | A1 | 3/2012 | Adachi et al. | |
| 2013/0247855 | A1 | 9/2013 | Adachi et al. | |

FOREIGN PATENT DOCUMENTS

| | | | |
|---|---|---|---|
| JP | 2000-161028 | A | 6/2000 |
| JP | 2001-115807 | A | 4/2001 |
| JP | 2010-190144 | A | 9/2010 |
| JP | 2010-203233 | A | 9/2010 |
| JP | 2012-057578 | A | 3/2012 |
| JP | 2012-107600 | A | 6/2012 |
| WO | 2012/111388 | A1 | 8/2012 |

OTHER PUBLICATIONS

Written Opinion (PCT/ISA/237) mailed on Jul. 23, 2013, by the Japanese Patent Office as the International Searching Authority for International Application No. PCT/JP2013/066943.

Notification of Transmittal of Translation of the International Preliminary Report on Patentability(Form PCT/IB/373) and the Written Opinion of the International Searching Authority (Form PCT/ISA/237) issued on Mar. 10, 2015 in the corresponding International Application No. PCT/JP2013/066943. (6 pages).

Japanese Office Action issued Oct. 6, 2015, by the Japan Patent Office, in corresponding Japanese Patent Application No. 2012-194377 with English translation of Office Action (5 pages).

European Search Report issued Dec. 10, 2015, by the European Patent Office, in corresponding European Patent Application No. 13835836.1 (9 pages).

* cited by examiner

VALVE TIMING CONTROLLER

TECHNICAL FIELD

This invention relates to a valve timing controller having a driving-side rotary member rotated in synchronism with a crankshaft of an internal combustion engine, a driven-side rotary member mounted coaxial with and on an inner circumferential side of the driving-side rotary member to be rotatable relative to the driving-side rotary member, the driven-side rotary member being rotated in synchronism with a valve opening/closing cam shaft of the internal combustion engine, a fluid pressure chamber formed between the driving-side rotary member and the driven-side rotary member, an advancing chamber and a retarding chamber formed as the fluid pressure chamber is partitioned by a partitioning portion provided on an outer circumferential side of the driven-side rotary member, a phase controlling section controlling a rotational phase of the driven-side rotary member relative to the driving-side rotary member, wherein the driven-side rotary member includes an advancing passage communicated to the advancing chamber and a retarding chamber communicated to the retarding chamber.

BACKGROUND ART

With the above-described valve timing controller, conventionally, the driving rotary member and the driven rotary member are formed of a single material such as an aluminum-based material, e.g. an aluminum alloy or an iron-based material, e.g. an iron-based sintered material, etc. (see e.g. Patent Document 1). Further, for the purpose of precision control of a spacing between the driving-side rotary member and the driven-side rotary member which are moved in sliding contact with each other, it is generally implemented to form the driving-side rotary member and the driven-side rotary member of a common material.

CITATION LIST

Patent Literature

Patent Document 1: Japanese Unexamined Patent Application Publication No. 2001-115807

SUMMARY OF INVENTION

Technical Problem

In case the driving-side rotary member and the driven-side rotary member are formed of an aluminum-based material, it is easy to achieve weight reduction, but as the aluminum-based material has a lower strength than an iron-based material, it is necessary to ensure a predetermined volume at certain portions thereof such as a portion connected to a cam bolt, which portion is subjected to a large external force. Therefore, in the case of using an aluminum-based material, it is difficult to realize compactization of the two rotary members, while ensuring a required strength at the same time. Further, in case the driving-side rotary member and the driven-side rotary member are formed of an iron-based material, it is easy to realize compactization of the two rotary members, while ensuring the required strength, but it is difficult to realize weight reduction. The present invention has been made in view of the above-described state of the art and its object is to provide a valve timing controller that makes it easy to ensure a required strength, while realizing both weigh reduction and compactization.

Solution to Problem

According to a characterizing feature of a valve timing controller of the present invention, the valve timing controller comprises: a driving-side rotary member rotated in synchronism with a crankshaft of an internal combustion engine, a driven-side rotary member mounted coaxial with and on an inner circumferential side of the driving-side rotary member to be rotatable relative to the driving-side rotary member, the driven-side rotary member being rotated in synchronism with a valve opening/closing cam shaft of the internal combustion engine, a fluid pressure chamber formed between the driving-side rotary member and the driven-side rotary member, an advancing chamber and a retarding chamber formed as the fluid pressure chamber is partitioned by a partitioning portion provided on an outer circumferential side of the driven-side rotary member, a phase controlling section controlling a rotational phase of the driven-side rotary member relative to the driving-side rotary member by supplying pressure fluid to the advancing chamber or the retarding chamber;

wherein the driven-side rotary member includes an advancing passage communicated to the advancing chamber and a retarding passage communicated to the retarding chamber;

wherein the driving-side rotary member is formed of an aluminum-based material; and wherein the driven-side rotary member integrally includes a cylindrical outer circumferential member having the partitioning portion and formed of an aluminum-based material, and a cylindrical inner circumferential member constituting an inner circumferential side of the outer circumferential member and formed of an iron-based material.

With the valve timing controller having the above-described configuration, the driving-side rotary member is formed of an aluminum-based material and the driven-side rotary member integrally includes a cylindrical outer circumferential member having the partitioning portion and formed of an aluminum-based material and a cylindrical inner circumferential member constituting an inner circumferential side of the outer circumferential member and formed of an iron-based material. That is, of the driven-side rotary member, its inner circumferential member for which strength is required in particular is formed of an iron-based material, so that it is easy to ensure a required strength while realizing compactization of the driven-side rotary member at the same time. Further, since the driving-side rotary member and the outer circumferential member of the driven-side rotary member which circumferential member effects a sliding movement relative to the driving-side rotary member are formed of an aluminum-based material. Therefore, precision control of the spacing between the driving-side rotary member and the driven-side rotary member can be realized easily. Also, in comparison with a case wherein the entire driven-side rotary member and the entire driving-side rotary member are formed of an iron-based material, weight (mass) reduction is made possible. Accordingly, with the valve timing controller having the above-described configuration, a required strength can be easily ensured while weight reduction and compactization are realized at the same time.

According to a further characterizing feature of the present invention, the outer circumferential member and the inner circumferential member are fitted to each other in a direction along a rotational axis and engaged with each other in a direction about the rotational axis via at least one stopper pin.

With the above-described configuration, even in such an event as occurrence of loosening in the fitting between the outer circumferential member and the inner circumferential member due to a difference of thermal expansion ratios of the outer circumferential member and the inner circumferential member, thanks to the mutual engagement therebetween via the stopper pin in the direction about the rotational axis, it is still possible to restrict relative displacement between the outer circumferential member and the inner circumferential member in the rotational circumferential direction.

According to a still further characterizing feature of the present invention, the stopper pin is fitted to the outer circumferential member and the inner circumferential member in a direction intersecting the rotational axis, at a position overlapped with an opening portion provided in the advancing passage or the retarding passage on a side thereof facing the fluid pressure chamber as seen in the direction of the rotational axis.

The advancing passage and the retarding passage are provided at positions communicated respectively to the advancing chamber and the retarding chamber, whichever phase the driven-side rotary member may be present. Therefore, in many cases, these advancing and retarding passages are provided usually in the vicinity of a base end portion of the partitioning portion of the driven-side rotary member. Further, between the driving-side rotary member and the driven-side rotary member, there is provided a sealing member for maintaining seal between the advancing chamber and the retarding chamber. This sealing member is often provided in a projecting portion of the driving-side rotary member which portion projects toward the driven-side rotary member. This sealing member, on the side of the driven-side rotary member, is often provided at a mid position between adjacent partitioning portions. Therefore, by providing the stopper pin at a position overlapped with the advancing passage or the retarding passage as seen in the direction of the rotational axis, the stopper pin and the seal member are always present in different from each other. With this, it becomes possible to prevent damage to the sealing performance at the position of the stopper pin.

According to a still further characterizing feature of the present invention, the stopper pin comprises a hollow pin and the stopper pin is fitted to the outer circumferential member and the inner circumferential member in the direction intersecting the rotational axis, and an inner side of the hollow stopper pin forms the advancing passage or the retarding passage.

In the case of using a pin as a member for preventing relative rotation between the outer circumferential member and the inner circumferential member together constituting the driven-side rotary member, this pin needs to have a predetermined strength. That is, as it is not needed to provide it with a strength more than necessary, the required strength can be secured even if this pin has a hollow structure. As this pin is disposed in the direction intersecting the rotational axis, its direction is same as those of the advancing passage and the retarding passage. Then, by using a hollow stopper pin as proposed as above, it is possible to obtain the advancing passage and the retarding passage without increasing the number of steps for working the driven-side rotary member and to increase the rotation preventing, i.e. stopper effect between the outer circumferential member and the inner circumferential member at the same time.

According to a still further characterizing feature of the present invention, the valve timing controller further comprises a fixed support portion for rotatably supporting an inner circumferential side of the driven-side rotary member coaxially with the driving-side rotary member; and the driven-side rotary member includes the advancing passage and the retarding passage such that these passages are communicated to the inner circumferential side of this driven-side rotary member; the fixed support portion includes fluid passages that can respectively be communicated to the advancing passage and the retarding passage; the each fluid passage includes an annular circumferential groove formed in an outer circumferential face of the fixed support portion: and the stopper pin is fitted to the outer circumferential member and the inner circumferential member in the direction intersecting the rotational axis in such a manner that one end side of the stopper pin faces the circumferential groove.

With the valve timing controller having the above-described arrangement, as pressure fluid is supplied from the fluid passage included in the fixed support portion to the advancing chamber or the retarding chamber via the advancing passage or the retarding passage included in the driven-side rotary member supported to this fixed support portion, the driven-side rotary member is slidably moved relative to the driving-side rotary member, thus controlling the rotational phase between the two rotary members. Therefore, pressure loss in the pressure fluid supplied to the advancing chamber or the retarding chamber is reduced, so that the response of the phase control by the phase controlling section can be improved. However, as the inner circumferential side of the driven-side rotary member is rotatably supported by the fixed support portion, the thickness of the driven-side rotary member in the rotational radial direction is reduced, which makes it difficult to ensure the strength of the driven-side rotary member. With the above-described arrangement, the stopper pin is fitted to the outer circumferential member and the inner circumferential member in the direction intersecting the rotational axis in such a manner that one end side of the stopper pin faces the circumferential groove formed in the outer circumferential face of the fixed support portion. Therefore, while ensuring a sufficient fitting depth of the stopper pin relative to the inner circumferential member, it is possible to dispose the stopper pin in such a manner as not to interfere with the sealing member fitted along the circumferential groove formed in the outer circumferential face of the fixed support portion and between this fixed support portion and the inner circumferential member.

According to a still further characterizing feature of the present invention, the stopper pin is fitted to the outer circumferential member and the inner circumferential member in the direction along the rotational axis.

With the above-described arrangement, as the outer circumferential member and the inner circumferential member are fitted with each other in the direction along the rotational axis via the stopper pin, in comparison with a case wherein the stopper pin is fitted in the direction intersecting the rotational axis, it is possible to secure a longer fitting length for the stopper pin, so that the engagement posture between the outer circumferential member and the inner circumferential member can be stabilized.

According to a still further characterizing feature of the present invention, the partitioning portion is formed integrally in the outer circumferential member; and the stopper pin is fitted to a portion of the outer circumferential member which portion forms the partitioning portion and the inner circumferential member.

The portion of the outer circumferential member integrally forming the partitioning portion bulges more toward the driving-side rotary member than the other portion thereof. Then, with the above-described arrangement, since the stopper pin is fitted in the direction along the rotational axis between such portion forming the partitioning portion and the inner circumferential member, it is possible to restrict deformation of the outer circumferential member which may occur in association with fitting of the stopper pin, so that the fitting strength of the stopper pin can be enhanced.

DESCRIPTION OF EMBODIMENTS

Embodiments of a valve timing controller relating to the present invention will be described next, with reference to the accompanying drawings.

First Embodiment

Figure 1:
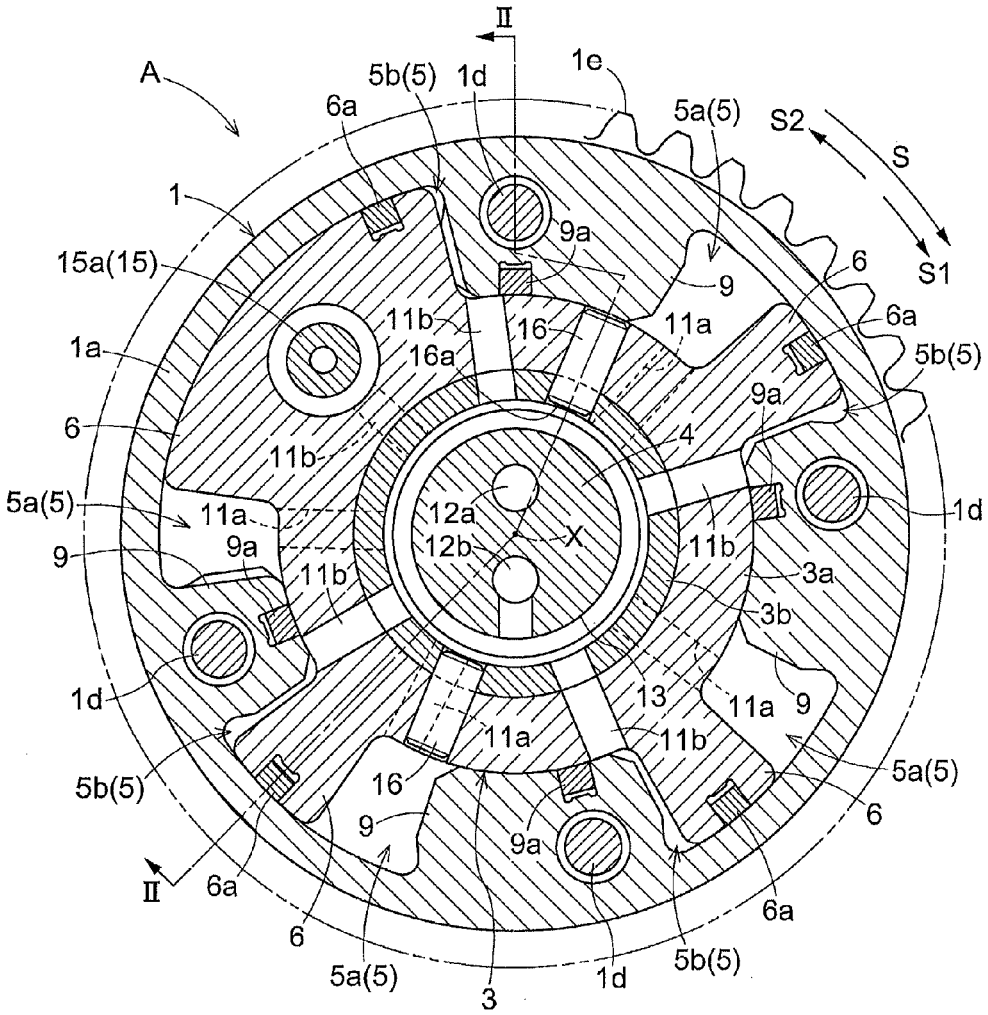
FIG. 1 is a front view showing an inside of a valve timing controller.
Figure 2:
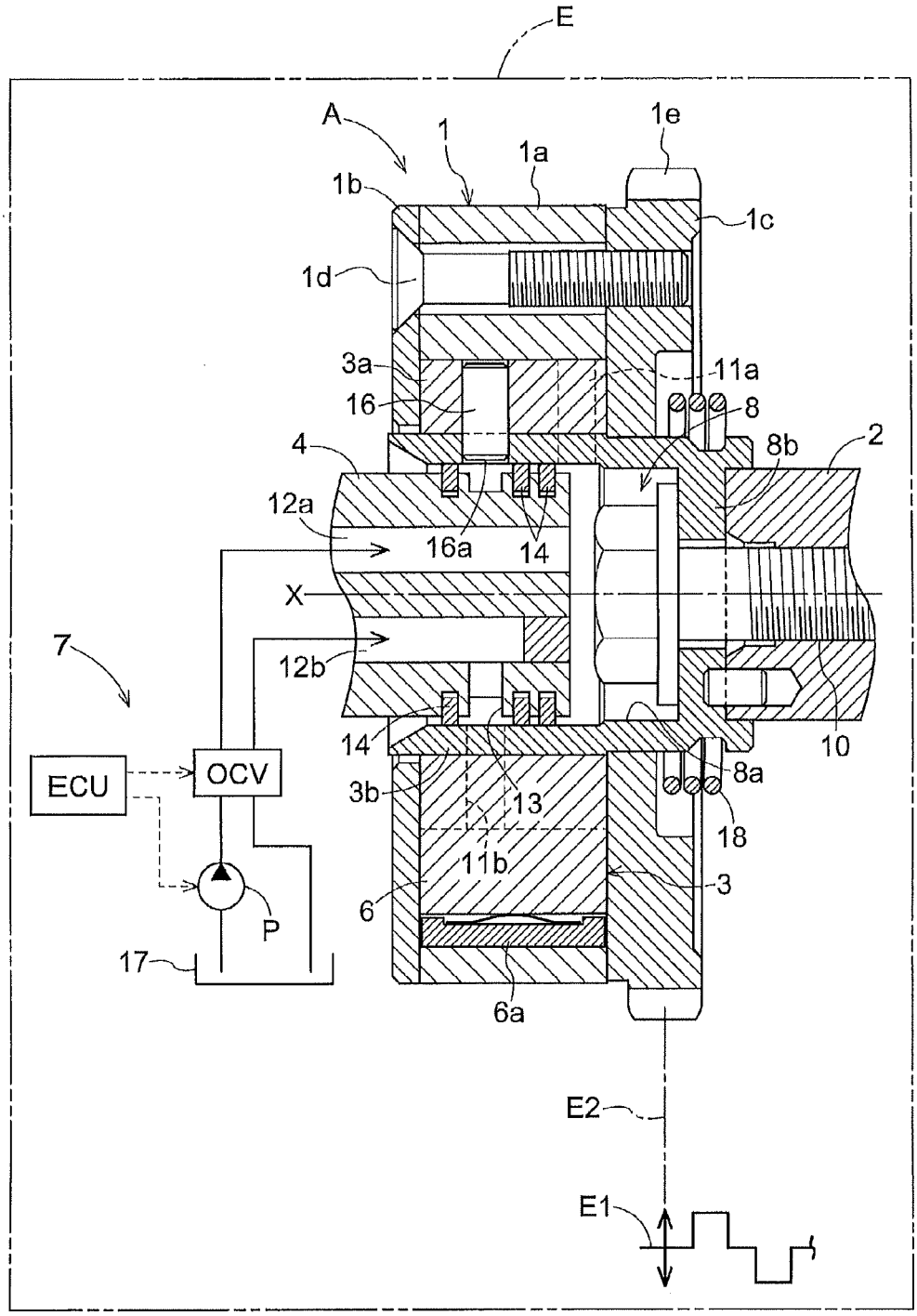
FIG. 2 is a section view taken along a line II-II in FIG. 1.
Figure 3:
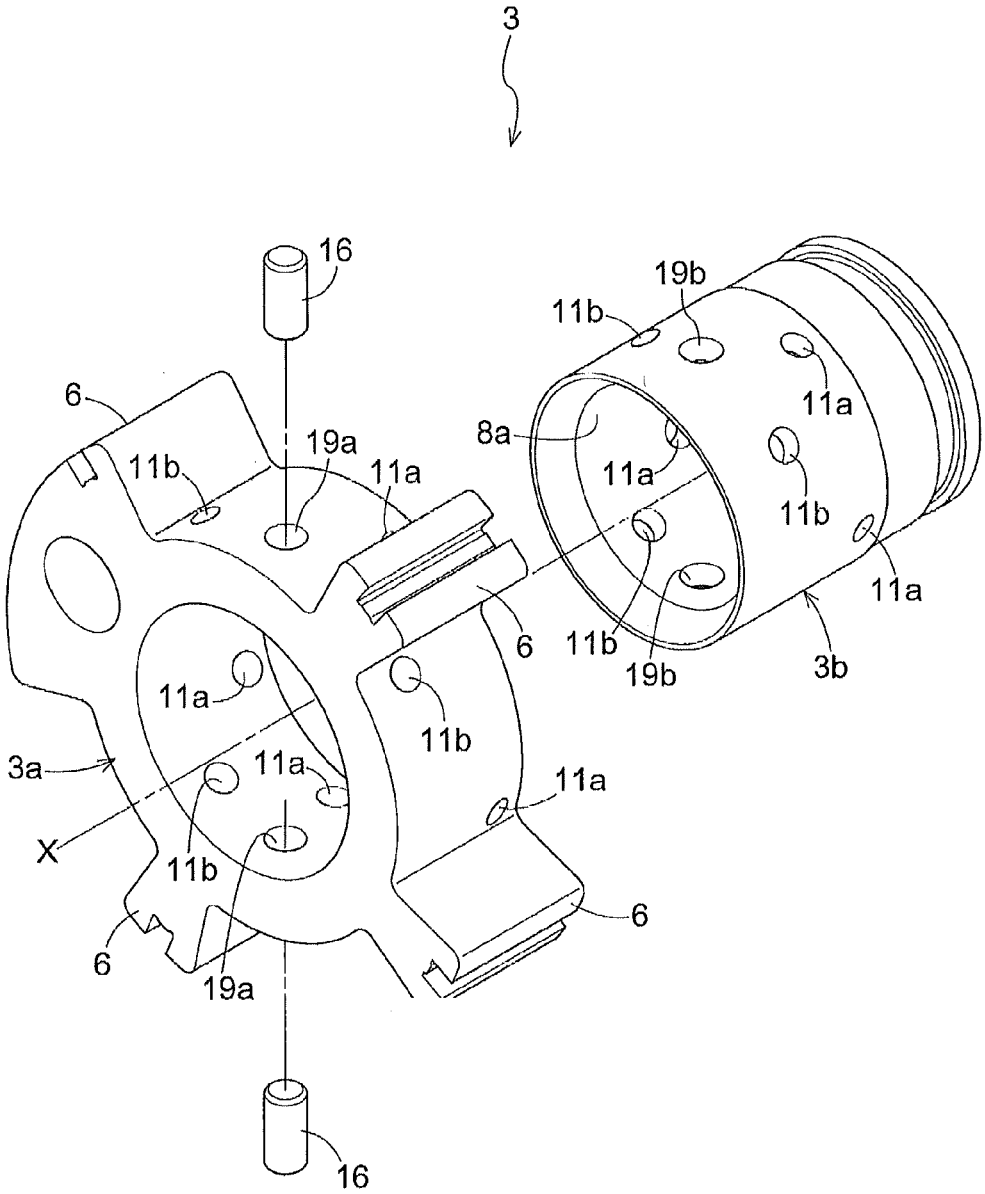
FIG. 3 is an exploded perspective view of an inner rotor (a "driven-side rotary member")

A valve timing controller A, as shown in FIGS. 1 through 3, includes a housing 1 as a "driving-side rotary member" rotated in synchronism with a crankshaft E1 of a gasoline engine (an internal combustion engine) E for an automobile, an inner rotor 3 as a "driven-side rotary member" disposed coaxially on an inner circumferential side of the housing 1 to be rotatable relative to housing 1, the inner rotor 3 being rotated in synchronism with a valve opening/closing cam shaft 2 of the engine E, a fixed shaft portion 4 as a "fixed support portion" for supporting an inner circumferential side of the inner rotor 3 with allowing its rotation about a rotational axis X shared by the housing 1, a fluid pressure chamber 5 formed between the housing 1 and the inner rotor 3, an advancing chamber 5*a* and a retarding chamber 5*b* formed as the fluid pressure chamber 5 is partitioned by a partitioning portion 6 formed integrally in an outer circumferential side of the inner rotor 3, and a phase controlling section 7 for controlling rotational phase of the inner rotor 3 relative to the housing 1 in response to supply of an amount of work oil (engine oil) as "pressure fluid" to the advancing chamber 5*a* or the retarding chamber 5*b*. The cam shaft 2 is rotatably assembled to a cylinder head (not shown) of the engine E. The fixed shaft portion 4 is fixed to a stationary component such as a front cover of the engine E.

The housing 1 includes an outer rotor 1*a* having a cylindrically shaped outer circumference, a front plate 1*b* disposed on the front side of the outer rotor 1*a*, and a rear plate 1*c* disposed on the rear side of the outer rotor 1*a*, with these components being fixed integrally together via connecting bolts 1*d*. The outer rotor 1*a*, the front plate 1*b* and the rear plate 1*c* are all formed of an aluminum-based material such as an aluminum alloy.

On the outer circumferential side of the rear plate 1*c*, a sprocket 1*e* is provided coaxially and integrally therewith. On and around this sprocket 1*e* and a further sprocket mounted on the crankshaft E1, a loop of a power transmission member E2 such as a timing chain or belt is entrained. The housing 11 is rotated in a direction denoted with an arrow S by drive force of the engine E.

The inner rotor 3 is fixed to a leading end of the cam shaft 2 having a cam (not shown) for controlling opening/closing of an intake valve or an exhaust valve of the engine E. The inner rotor 3 is driven to rotate in the arrow S direction in association with rotation of the housing 1.

The inner rotor 3 has a recess portion 8 having an inner circumferential face 8*a* having a cylindrical shape coaxial with the rotational axis X. And, the inner rotor 3 and the cam shaft 2 are fixed together with threading engagement of a bolt 10 inserted into a bottom plate portion 8*b* of the recess portion 8 into the cam shaft 2 coaxially therewith. A torsion coil spring 18 for urging the rotational phase of the inner rotor 3 relative to the housing 1 to the advancing side is fitted to and between the inner rotor 3 and the rear plate 1*c*.

On the inner circumferential side of the outer rotor 1*a*, there are integrally formed a plurality (four in this embodiment) of projecting portions 9 projecting toward the radial inner side and provided at positions spaced apart from each other in the circumferential direction. Each projecting portion 9 is configured such that its projecting end comes into sliding contact with the outer circumferential face of the inner rotor 3 via a sealing member 9*a*.

Between respective circumferentially adjacent pairs of projecting portions 9 and between the outer rotor 1*a* and the inner rotor 3, four fluid pressure chambers 5 are formed. The connecting bolt 1*d* is inserted through each projecting portion 9 to fix the outer rotor 1*a*, the front plate 1*b* and the rear plate 9*c* together.

At each of positions of the inner rotor 3 facing the respective fluid pressure chambers 5, a plurality (four in this embodiment) of the partitioning portions 6 projecting radially outwards are formed integrally at positions spaced apart from each other in the circumferential direction. Each partitioning portion 6 is configured such that its projecting end comes into sliding contact with the inner circumferential face of the outer rotor 1*a* via the sealing member 6*a*. Each fluid pressure chamber 5 is partitioned into the advancing chamber 5*a* and the retarding chamber 5*b* adjacent each other in the rotational direction.

The inner rotor 3 includes an advancing passage 11*a* communicated to the advancing chamber 5*a* and a retarding passage 11*b* communicated to the retarding chamber 5*b*, with these passages 11*a*, 11*b* being communicated to the inner circumferential side of the inner rotor 3, that is, to the recess portion 8. More particularly, the advancing passage 11*a* is communicated to the recess portion 8 at a position on the side of the rear plate 1*c* and facing a space between the fixed shaft portion 4 and the bottom plate portion 8*b*, whereas the retarding passage 11*b* is communicated to the recess portion 8 at a position on the side of the front plate 1*b* and at a position facing the outer circumferential face of the fixed shaft portion 4.

The fixed shaft portion 4 includes an advancing-side supply passage 12*a* as a fluid passage communicable to the advancing passage 11*a* and a retarding-side supply passage 12*b* as a fluid passage communicable to the retarding passage 11*b*. The advancing-side supply passage 12*a* is communicated through one axial end side of the fixed shaft portion 4 to the space between the fixed shaft portion 4 and the base plate portion 8*b*. The retarding-side supply passage 12*b* is communicated to an annular circumferential groove 13 formed in the outer circumferential face of the fixed shaft portion 4. On the opposed sides of the annular circumferential groove 13 and on one axial end side of the fixed shaft portion 4, there are respectively attached sealing rings 14 sealing gap between the outer circumferential face of the fixed shaft portion 4 and the inner circumferential face of the recess portion 8.

Between and across the inner rotor 3 and the housing 1, there is provided a lock mechanism 15 configured to selectively provide a locking state for locking the rotational phase of the inner rotor 3 relative to the housing 1 to a most retarded position and a lock-releasing state for releasing the lock. The lock mechanism 15 includes a locking member 15*a* having a leading end projectable/retractable to/from a recess portion (not shown) formed in the rear plate 1*c* in the direction along the rotational axis X. With this lock mechanism 15 in operation, the locking state is selectively provided when the leading end of the locking member 15*a* enters the recess portion due to an urging force of an urging member such as a compression spring (not shown) and the lock-releasing state is selectively provided when the leading end is retracted from the recess portion toward the inner rotor 3 against the urging force of the urging member, by a work oil pressure (a fluid pressure).

The inner rotor 3, as shown in FIG. 3 also, includes, a cylindrical outer circumferential member 3*a* integrally forming the each partitioning portion 6 and formed of an aluminum-based material such as an aluminum alloy and an inner circumferential member 3*b* having a bottomed cylindrical shape, the inner circumferential member 3*b* constituting the inner circumferential side relative to the outer circumferential side thereof and being formed of an iron-based material such as an iron-based sintered material, with these members 3*a*, 3*b* being coaxial with the rotational axis X. The recess portion 8 is formed in the inner circumferential member 3*b* and this inner circumferential member 3*b* and the cam shaft 2 are fixed together via the bolt 10.

The outer circumferential member 3*a* and the inner circumferential member 3*b* are fitted with each other as being pressed in the direction along the rotational axis X and are engaged with each other in a direction around the rotational axis X via cylindrical stopper pins 16 formed of solid steel and disposed at positions radially opposed to each other.

The each stopper pin 16 is unwithdrawably fitted as being pressed into and through a fitting hole 19*a* formed through the outer circumferential member 3*a* and a fitting hole 19*b* formed through the inner circumferential member 3*b* along a perpendicular direction intersecting the rotational axis X, such that one flat end face 16*a* thereof faces the annular circumferential groove 13. The fitting holes 19*a*, 19*b* are formed by drilling with a drilling tool such as a drill, after establishment of the mutual fitting of the outer circumferential member 3*a* and the inner circumferential member 3*b*. Incidentally, as an alternative arrangement, the outer circumferential member 3*a* and the inner circumferential member 3*b* can be engaged with each other in the direction around the rotational axis X via a single stopper pin 16.

The phase controlling section 7 includes an oil pump P for drawing/discharging an amount of work oil from an oil pan 17, a fluid control valve OCV for effecting feeding/discharging of the work oil relative to the advancing-side supply passage 12*a* and the retarding-side supply passage 12*b* and stopping these feeding and discharging operations when needed, and an electronic control unit ECU for controlling operations of the fluid control valve OCV.

In response to work oil feeding/discharging operation by the phase controlling section 7, a rotational phase of the inner rotor 3 relative to the housing 1 is displaced in an advancing direction denoted with an arrow S1 (direction for increasing the capacity of the advancing chamber 5*a*) or in a retarding direction denoted with an arrow S2 (direction for increasing the capacity of the retarding chamber 5*b*) and then is maintained at a desired phase in response to stopping of the feeding/discharging operation. Incidentally, the lock mechanism 15 is configured to be switched over from the locking state to the lock-releasing state in response to a work oil feeding operation to the advancing chamber 5*a*.

Second Embodiment

Figure 4:
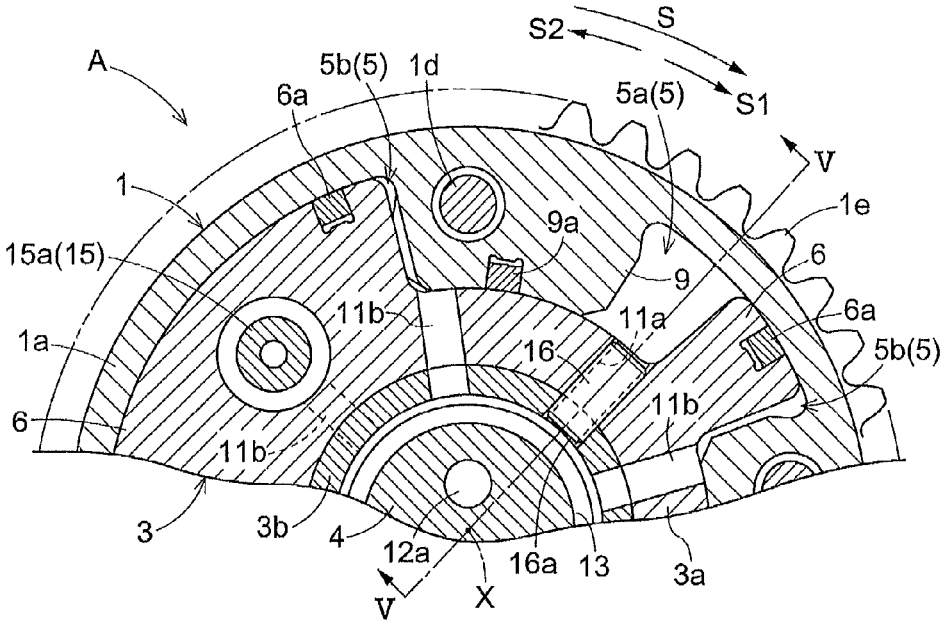
FIG. 4 is a front view of principal portions showing an inside of a valve timing controller according to a second embodiment.
Figure 5:
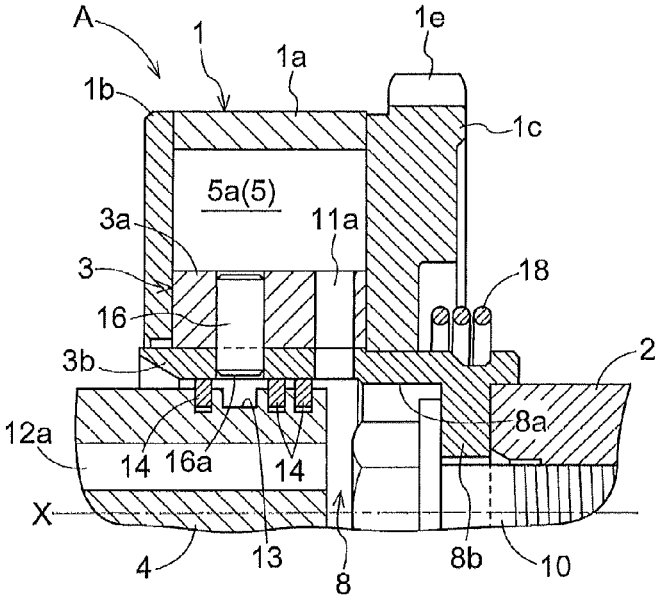
FIG. 5 is a section view taken along a line V-V in FIG. 4.

FIGS. 4 and 5 show a second embodiment of the present invention. In this embodiment, the stopper pin 16 is fitted to the outer circumferential member 3*a* and the inner circumferential member 3*b* in the perpendicular direction intersecting the rotational axis X, at a position overlapped with an opening portion of the advancing passage 11*a* facing the fluid pressure chamber 5 side as viewed along the rotational axis X direction, where the one end face 16*a* of the pin 16 faces the annular circumferential groove 13. The rest of the configuration is identical to that of the first embodiment.

Incidentally, though not shown, the stopper pin 16 can be fitted to the outer circumferential member 3*a* and the inner circumferential member 3*b* in the perpendicular direction intersecting the rotational axis X, at a position overlapped with an opening portion of the retarding passage 11*b* facing the fluid pressure chamber 5 side as viewed along the rotational axis X direction.

Third Embodiment

Figure 6:
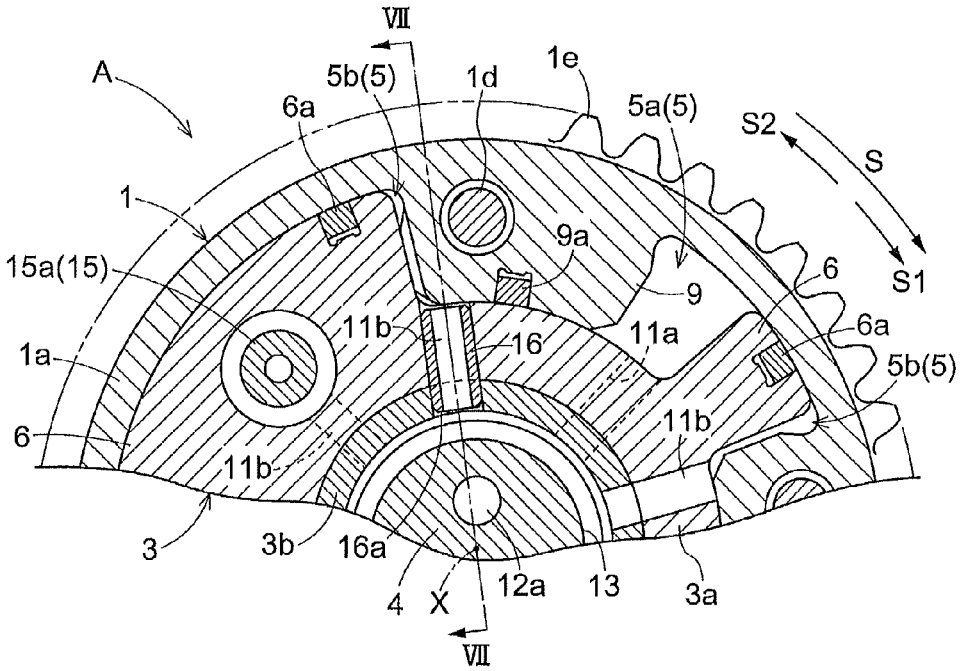
FIG. 6 is a front view of principal portions showing an inside of a valve timing controller according to a third embodiment.
Figure 7:
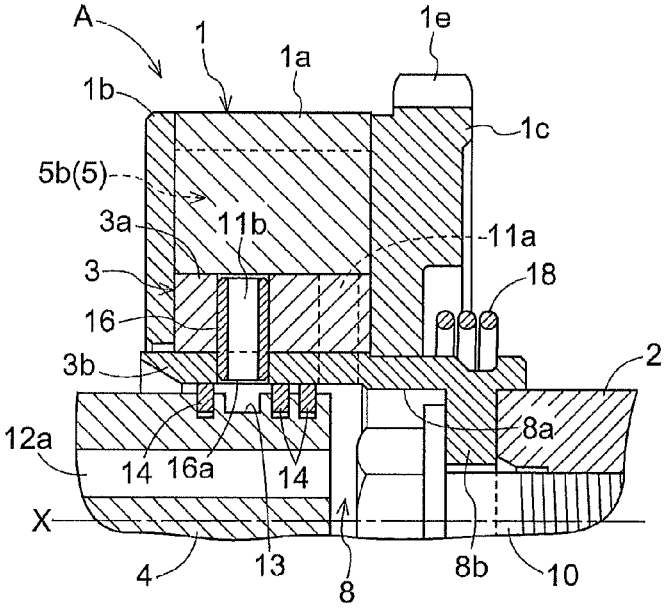
FIG. 7 is a section view taken along a line VII-VII in FIG. 6.

FIGS. 6 and 7 show a third embodiment of the present invention. In this embodiment, the stopper pin 16 is provided as a cylindrical hollow pin and this pin 16 is fitted to the outer circumferential member 3*a* and the inner circumferential member 3*b* in the perpendicular direction intersecting the rotational axis X, with the inner side of the hollow stopper pin 16 forming the retarding passage 11*b*. The rest of the configuration is identical to that of the first embodiment. Incidentally, though not shown, the inner side of the hollow stopper pin 16 may form the advancing passage 11*a*.

Fourth Embodiment

Figure 8:
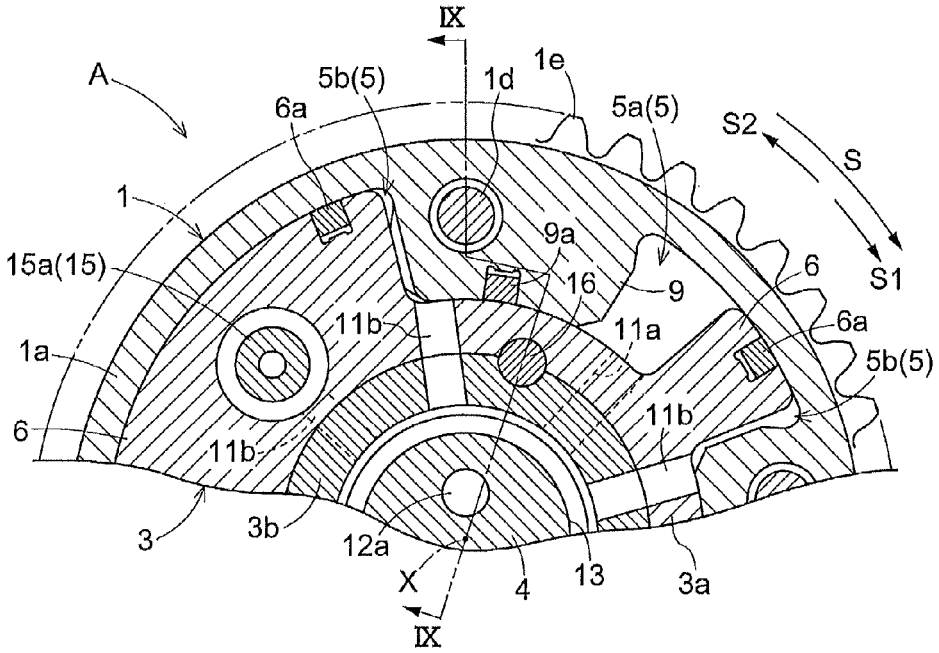
FIG. 8 is a front view of principal portions showing an inside of a valve timing controller according to a fourth embodiment.
Figure 9:
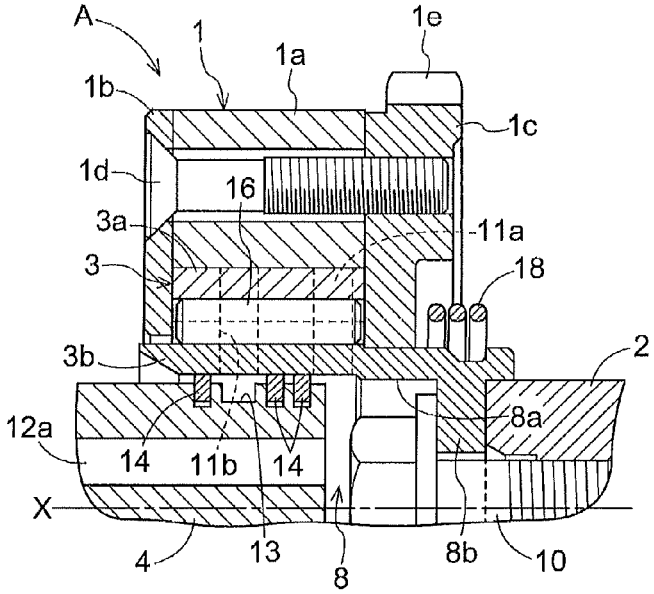
FIG. 9 is a section view taken along a line IX-IX in FIG. 8.

FIGS. 8 and 9 show a fourth embodiment of the present invention. In this embodiment, at respective radially opposed portions of the outer circumferential member 3*a* not forming the partitioning portion 6, a solid stopper pin 16 is fitted to the outer circumferential member 3*a* and the inner circumferential member 3*b* in the direction along the rotational axis X. The rest of the configuration is identical to that of the first embodiment.

Fifth Embodiment

Figure 10:
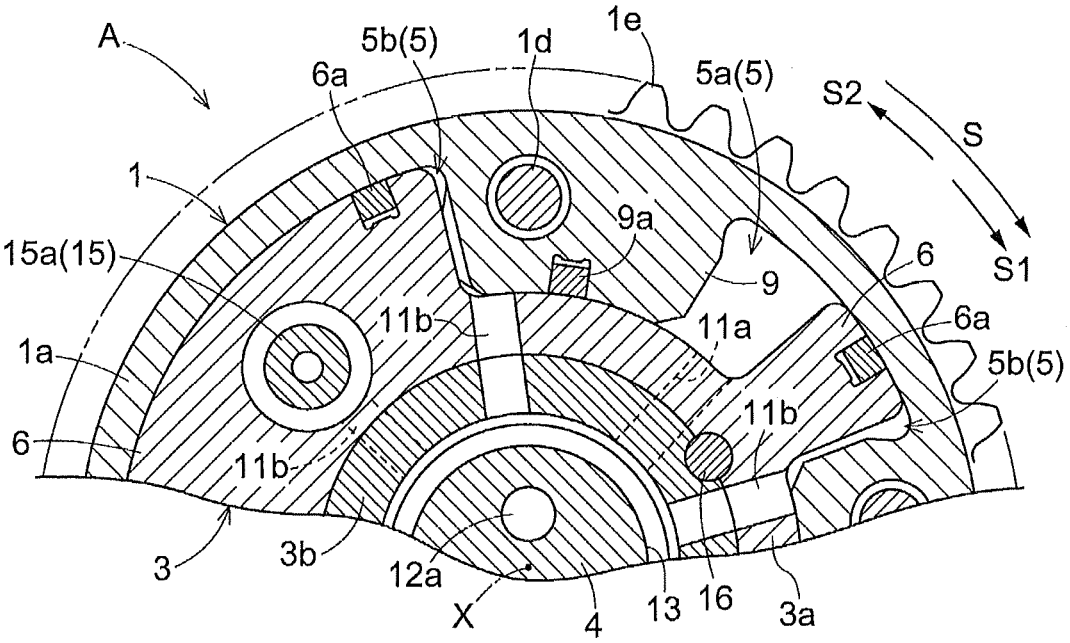
FIG. 10 is a front view of principal portions showing an inside of a valve timing controller according to a fifth embodiment.

FIG. 10 shows a fifth embodiment of the present invention. In this embodiment, at respective radially opposed portions of the outer circumferential member 3*a* forming the partitioning portion 6, a solid stopper pin 16 is fitted to the outer circumferential member 3*a* and the inner circumferential member 3*b* in the direction along the rotational axis X. The rest of the configuration is identical to that of the first embodiment.

Other Embodiments

1. In the valve timing controller according to the present invention, the inner rotor 3 can integrally include the outer circumferential member 3*a* and the inner circumferential member 3*b* via spline fitting.

2. In the valve timing controller according to the present invention, the outer circumferential member 3*a* and the inner circumferential member 3*b* can be engaged with each other in the direction around the rotational axis X, via a stopper pin 16 having a round or angular cross section.

3. In the valve timing controller according to the present invention, the outer circumferential member 3*a* and the inner circumferential member 3*b* can be fitted loosely to be insertable/withdrawable to/from each other or can be unwithdrawably and strongly fitted to each other via hot caulking or cold caulking, etc.

4. In the valve timing controller according to the present invention, the stopper pin 16 can be unwithdrawably fitted to the outer circumferential member 3*a* and the inner circumferential member 3*b* via hot caulking or cold caulking, etc.

5. In the valve timing controller according to the present invention, the controller can be configured such that pressure fluid is fed to the advancing chamber 5*a* and the retarding chamber 5*b* via the advancing passage 11*a* and the retarding passage 11*b* from the cam shaft 2 side.

6. In the valve timing controller according to the present invention, the partitioning portion 6 for partitioning the fluid pressure chamber 5 into the advancing chamber 5*a* and the retarding chamber 5*b* can be comprised of a plate-like vane member fitted in a vane groove formed in the outer circumferential member 3*a*.

INDUSTRIAL APPLICABILITY

The present invention is applicable to a valve timing controller for various internal combustion engines of an automobile, etc.

REFERENCE SIGNS LIST

1 outer rotor (driving-side rotary member)
2 cam shaft
3 inner rotor (driven-side rotary member)
3*a* outer circumferential member
3*b* inner circumferential member
4 fixed shaft portion (fixed support portion)
5 fluid pressure chamber
5*a* advancing chamber
5*b* retarding chamber
6 partitioning portion
7 phase controlling section
11*a* advancing passage
11*b* retarding passage
12*a*, 12*b* fluid passage
13 circumferential groove
16 stopper pin
E internal combustion engine
E1 crankshaft
X rotational axis

The invention claimed is:

1. A valve timing controller comprising:

a driving-side rotary member rotated in synchronism with a crankshaft of an internal combustion engine;

a driven-side rotary member mounted coaxial with and on an inner circumferential side of the driving-side rotary member to be rotatable relative to the driving-side rotary member, the driven-side rotary member being rotated in synchronism with a valve opening/closing cam shaft of the internal combustion engine;

a fluid pressure chamber formed between the driving-side rotary member and the driven-side rotary member;

an advancing chamber and a retarding chamber formed as the fluid pressure chamber is partitioned by a partitioning portion provided on an outer circumferential side of the driven-side rotary member; and a phase controlling section controlling a rotational phase of the driven-side rotary member relative to the driving-side rotary member by supplying pressure fluid to the advancing chamber or the retarding chamber, wherein the driven-side rotary member includes an advancing passage communicated to the advancing chamber and a retarding passage communicated to the retarding chamber;

wherein the driving-side rotary member is formed of an aluminum-based material; and wherein the driven-side rotary member integrally includes a cylindrical outer circumferential member having the partitioning portion and formed of an aluminum-based material, and an inner circumferential member constituting an inner circumferential side of the outer circumferential member and formed of an iron-based material.

2. The valve timing controller according to claim 1, wherein the outer circumferential member and the inner circumferential member are fitted with each other in a direction along a rotational axis and engaged with each other in a direction about the rotational axis via at least one stopper pin.

3. The valve timing controller according to claim 2, wherein the stopper pin is fitted to the outer circumferential member and the inner circumferential member in a direction intersecting the rotational axis, at a position overlapped with an opening portion provided in the advancing passage or the retarding passage on a side thereof facing the fluid pressure chamber as seen in the direction of the rotational axis.

4. The valve timing controller according to claim 2, wherein the stopper pin comprises a hollow pin and the stopper pin is fitted to the outer circumferential member and the inner circumferential member in the direction intersecting the rotational axis, and an inner side of the stopper pin forms the advancing passage or the retarding passage.

5. The valve timing controller according to claim 2, wherein the valve timing controller further comprises a fixed support portion for rotatably supporting an inner circumferential side of the driven-side rotary member coaxially with the driving-side rotary member;

wherein the driven-side rotary member includes the advancing passage and the retarding passage such that these passages are communicated to the inner circumferential side of this driven-side rotary member;

wherein the fixed support portion includes fluid passages that can respectively be communicated to the advancing passage and the retarding passage;

wherein the each fluid passage includes an annular circumferential groove formed in an outer circumferential face of the fixed support portion: and wherein the stopper pin is fitted to the outer circumferential member and the inner circumferential member in the direction intersecting the rotational axis in such a manner that one end side of the stopper pin faces the circumferential groove.

6. The valve timing controller according to claim 2, wherein the stopper pin is fitted to the outer circumferential member and the inner circumferential member in the direction along the rotational axis.

7. The valve timing controller according to claim 6, wherein the partitioning portion is formed integrally in the outer circumferential member; and the stopper pin is fitted to a portion of the outer circumferential member which portion forms the partitioning portion and the inner circumferential member.

* * * * *